US009731430B2

(12) United States Patent
De Marco et al.

(10) Patent No.: US 9,731,430 B2
(45) Date of Patent: Aug. 15, 2017

(54) TRANSVERSAL CUTTING EQUIPMENT FOR SHEETS SEPARABLE FROM OVERLAPPED CONTINUOUS FORMS

(71) Applicant: Tecnau S.r.L., Ivrea (IT)

(72) Inventors: Giuliano De Marco, Ivrea (IT); Armando Aprato, Ivrea (IT); Francesco Terrusi, Ivrea (IT); Francesco Modica, Ivrea (IT)

(73) Assignee: Technu S.r.l., Ivrea (IT)

( * ) Notice: Subject to any disclaimer, the term of this patent is extended or adjusted under 35 U.S.C. 154(b) by 367 days.

(21) Appl. No.: 14/262,079

(22) Filed: Apr. 25, 2014

(65) Prior Publication Data

US 2014/0318336 A1 Oct. 30, 2014

(30) Foreign Application Priority Data

Apr. 26, 2013 (IT) ..... TO2013A0344

(51) Int. Cl.
*B65H 33/12* (2006.01)
*B26D 7/27* (2006.01)
(Continued)

(52) U.S. Cl.
CPC ..... *B26D 7/27* (2013.01); *B65H 29/64* (2013.01); *B65H 35/04* (2013.01); *B65H 39/06* (2013.01);
(Continued)

(58) Field of Classification Search
CPC ..... B65H 29/64; B65H 35/04; B65H 39/06; B65H 39/16; B65H 2404/632; B26D 7/27; Y10T 83/0605; Y10T 83/647
(Continued)

(56) References Cited

U.S. PATENT DOCUMENTS 5,104,104 A * 4/1992 Mol ..... B65H 39/16 270/52.08
6,107,579 A * 8/2000 Kinnemann ..... B07C 1/02 177/119
(Continued)

FOREIGN PATENT DOCUMENTS

EP 2340918 6/2011
WO 2011036635 3/2011

*Primary Examiner* — Omar Flores Sanchez
(74) *Attorney, Agent, or Firm* — Banner & Witcoff, Ltd.

(57) ABSTRACT

Cutting equipment (41) which processes overlapped continuous forms (23H, 23L) is disclosed. The cutting is carried out by means of a cutting device (29), which separates the sheets from the forms, introduction devices (28H and 28L), which enter the continuous forms (23H, 23L) into the cutting device and a singularizing device (46) for overlapped sheets, which includes two transport paths (81 and 82), the one above the other, with differentiable transfer times; the singularizing device comprises a diverter (83) upstream of the transport paths (81 and 82); the introduction devices (28H and 28L) are actuatable for temporarily projecting a leading edge of one of the overlapped forms (23H, 23L) with respect to the other form up to a switching zone of the diverter (83), or for advancing together the overlapped forms (23H, 23L); the diverter (83) is configurable for addressing a continuous form or both forms (23H, 23L) to one or to both transport paths (81 and 82); and the introduction devices (28H and 28L) are also actuatable, in the case of projecting of one of the continuous forms, for lining up trailing edges of the sheets of the one and the other form for a joint cutting of the overlapped forms (23H, 23L) by means of the cutting device (29).

15 Claims, 10 Drawing Sheets

(51) Int. Cl.

| | |
|---|---|
| ***B65H 29/64*** | (2006.01) |
| ***B65H 35/04*** | (2006.01) |
| ***B65H 39/06*** | (2006.01) |
| ***B65H 39/16*** | (2006.01) |

(52) U.S. Cl.
CPC ..... *B65H 39/16* (2013.01); *B65H 2404/632* (2013.01); *Y10T 83/0605* (2015.04); *Y10T 83/647* (2015.04)

(58) Field of Classification Search
USPC ..... 83/56, 401; 270/52.09, 58.07, 58.23, 270/3.17; 271/270, 272
See application file for complete search history.

(56) References Cited

U.S. PATENT DOCUMENTS

| | | | | |
|---|---|---|---|---|
| 6,341,773 | B1 * | 1/2002 | Aprato | B65H 39/06 270/52.01 |
| 6,460,844 | B1 | 10/2002 | Clifford et al. | |
| 8,308,153 | B2 * | 11/2012 | De Marco | B26D 1/095 270/52.09 |
| 8,690,153 | B2 * | 4/2014 | Ponti | B65H 29/125 271/303 |
| 9,193,213 | B2 * | 11/2015 | Ponti | B65H 29/125 |

* cited by examiner

TRANSVERSAL CUTTING EQUIPMENT FOR SHEETS SEPARABLE FROM OVERLAPPED CONTINUOUS FORMS

RELATED APPLICATION

This application claims priority to Italian Application No. TO2013A000344 filed Apr. 26, 2013, and entitled "Improvements to a transversal cutting equipment for sheets separable from overlapped continuous forms", the content of which is incorporated herein by reference in its entirety.

FIELD

The present invention relates to improvements to a transversal cutting equipment for sheets separable from overlapped continuous forms.

More specifically, the invention relates to improvements to a transversal cutting equipment for sheets separable from overlapped continuous forms, comprising a cutting device for the joint transversal separation of the sheets, introduction devices for entering the forms into the cutting device and a singularizing device for the overlapped sheets including two transport paths, the one above the other, with differentiable transfer times.

BACKGROUND

Equipments of this type, commercially known as double cutters, are used in systems for automatic processing documents, which have been previously printed on continuous forms.

The double cutters can operate, "on-line", downstream from longitudinally cutting equipment, known as "merger" that divide the basic continuous forms in a longitudinal direction.

The double cutters of known type drive forward the continuous forms simultaneously or alternately and provide to separate, by means of a single blade, the printed sheets singularly or overlapped for the formation of the documents and following processings. For reason of cost and operational flexibility, cutting devices with alternative movements, for instance with guillotine blades, are used which require the stopping of the continuous form at the time of the cutting.

The operating velocity of the cutters on the market is conditioned by the velocity of the cutting device and the stresses to which are subjected the continuous forms entering in the equipment. Particularly good results have been obtained with the cutting equipment of the Italian Patent No. 1,360,399 in the name of Tecnau S.r.l. That equipment provides additional loops upstream of the cutting device and averaged velocities of the continuous forms at the inputs of the equipment. This allowed to reach the limit determined by the cutting device for the separation of the overlapping sheets. However, the overall productivity is lower than the theoretical productivity, when one of the continuous forms should be arrested for the production of documents with an odd number of sheets or for particular arrangements of the documents in undivided form. Further, the different velocities of the continuous forms, after the longitudinal separation by the "merger", makes more difficult the standardization of the velocity of the continuous forms at the input of the equipment.

A transversal cutting equipment for sheets separable from overlapped continuous forms is the subject of the Italian Patent IT 1.397.442, also in the name of Tecnau S.r.l: The equipment of IT 1.397.442 comprises a cutting device, which can be activated for the simultaneous separation of the sheets from the continuous forms and a singularizing device of overlapped sheets for solving problems concerning documents with an odd number of sheets. In a specific embodiment, the singularizing device comprises a separating mechanism of the overlapped forms, having suction rollers downstream of the cutting device, two transport paths lying one above the other downstream of the suction rollers and an accumulating and forwarding device. The cutting device operates in continuous mode on the overlapped forms, while the transport paths can transport the sheets with differentiated velocities. This allows that a cut sheet of a following document, other than the document in formation, is transferred to the accumulating and forwarding device for the formation of the new document, substantially after the forwarding of the previous document. The devices achieved in accordance with this patent are fast, even in the case of documents having a reduced and odd number of sheets, but result quite expensive.

BRIEF SUMMARY

An object of the present invention is to provide an equipment for transversal cutting and intermittent motion for continuous overlapped forms, of high reliability and velocity, which operates on overlapped continuous forms and which results of relatively low cost.

In accordance with this object, the equipment for transversal cutting of the invention comprises, as singularizing device, a diverter upstream of the transport paths and wherein the introduction devices are actuatable for temporarily projecting a leading edge of one of the overlapped forms with respect to the other form up to a switching zone of the diverter, or for advancing together the overlapped forms. The diverter is configurable for addressing a form or both forms to one or to both transport paths and the introduction devices are also actuatable, in the case of projecting of one of the forms, for lining up the trailing edges of the one and the other form for a joint cutting of the overlapped forms by means of the cutting device.

Another object of the invention is to provide a method for transversal cutting sheets separable from continuous overlapped forms, using a cutting equipment, comprising a cutting device for the joint transversal separation of the sheets; introduction devices for entering the forms into the cutting device and a singularizing device for the overlapped sheets including two transport paths, the one above the other, with differentiable transfer times. The cutting equipment further comprises as singularizing device a diverter upstream of the transport paths and wherein said method provides the following steps:

a) actuating the introduction devices for temporarily projecting a leading edge of one of the overlapped forms with respect to the other form up to a switching zone of the diverter, or for advancing together the overlapped forms;

b) configuring the diverter for addressing a form or both forms to one or to both transport paths; and c) actuating the introduction devices, in the case of projecting of one of the forms, for lining up the trailing edges of the one and the other form for a joint cutting of the overlapped forms by means of the cutting device.

BRIEF DESCRIPTION OF THE DRAWINGS

The characteristics of the invention will become clear from the following description, given purely by way of non-limiting example, with reference to the appended drawings in which.

DETAILED DESCRIPTION

Figure 1:
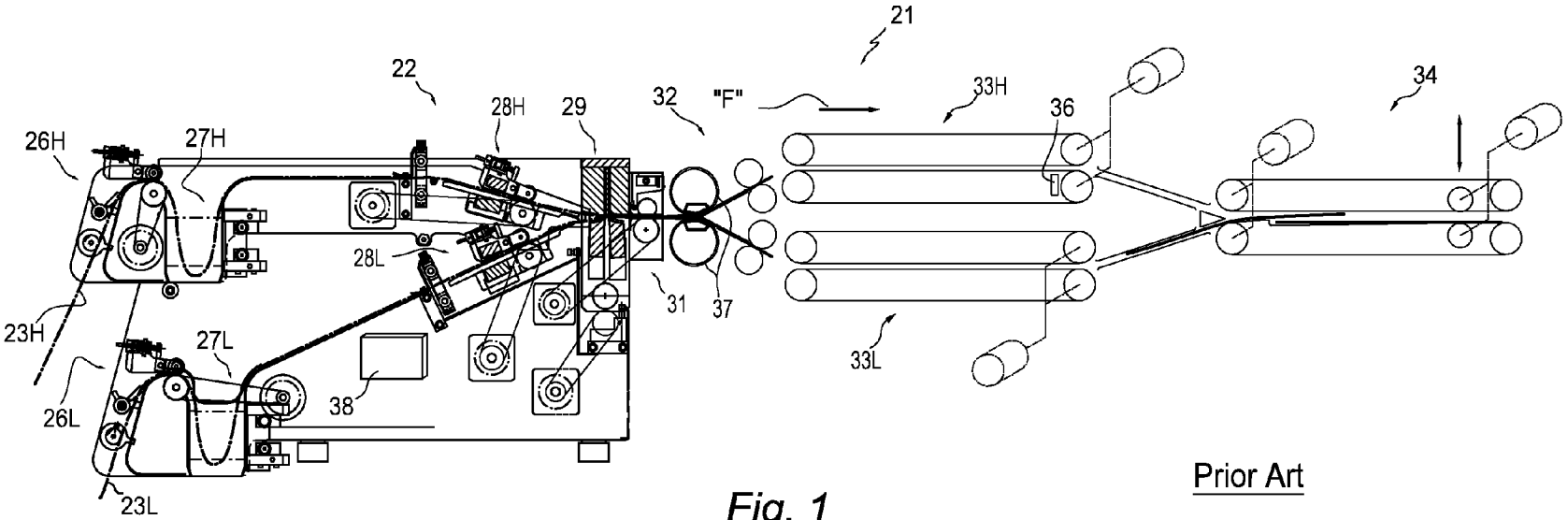
Prior Art Fig. 1
FIG. 1 represents a schematic view of a cutting equipment for overlapped continuous forms of known type.

FIG. 1 shows a cutting equipment 21 with a double cutter 22 for continuous overlapped forms 23H and 23L. The continuous forms 23H and 23L are derived, by longitudinal cutting, from a paper tape or continuous base form 24 (see FIG. 2), with advancement along a direction "F". The cutting equipment 21 is specifically of the type described in the cited Italian Patent No. 1,360,399, the content of which is an integral part of the present description.

In summary, the double cutter 22 comprises input feeding devices 26H and 26L, loop forming devices 27H and 27L, introduction devices 28L and 28H, a guillotine cutting device 29 and an extraction and trimming device 31.

The equipment 21 provides, in particular, a singularizing device for the overlapped sheets, which comprises a separation mechanism 32 of the overlapped continuous forms 23H and 23L, downstream of the cutting device 29, transport paths 33H and 33L at different heights, an accumulating and forwarding device or output buffer 34 and differentiating means 36 for modifying the transport times of the sheets separated from the continuous forms along the transport paths 33H and 33L. The cutting of the sheets is performed on the overlapped continuous forms, while the separation mechanism 32 includes suction rollers 37 for separating and spacing away the sheets after cutting and directing the sheets towards the transport paths 33H and 33L. An electronic unit 38 controls the kinematic components of the equipment 21 and, in particular, the respective singularizing device for the overlapped sheets.

The cutting equipment 21 is part of a system that receives sheets printed on continuous forms 24 and in which the separated sheets constitute the pages of various documents. In accordance with current standards, the pages belonging to a given document and the various documents are printed on the continuous base form 24 on columns arranged side by side and according to a predetermined regressive order (See FIG. 2) or progressive order.

The cutting device 29 operates on the overlapped continuous forms 23H and 23L, while the equipment 21 handles a loss of parity of the overlapped forms by modifying the transfer times of the sheets along the transport paths 33H and 33L. In particular, the differentiating means 36 is actuatable for stopping or slowing a cut sheet of a following document, different from the current document in formation, while the sheet of the current document is transferring to the output buffer 34 by completing the forming of the document.

Figure 3:
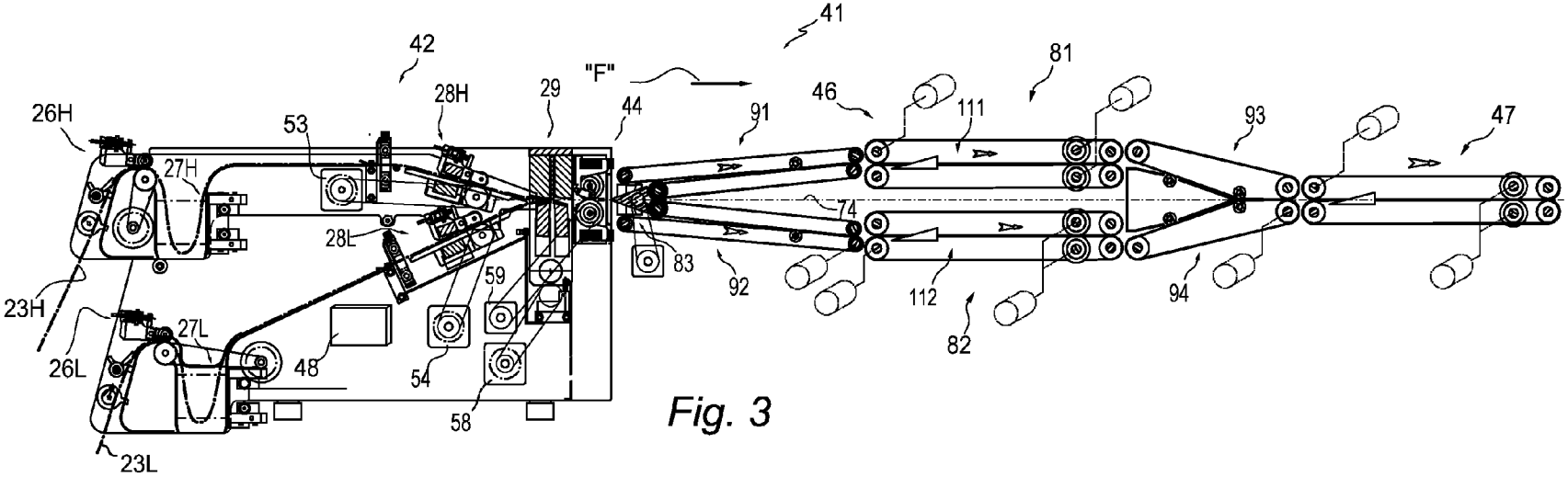
FIG. 3 is a schematic view of a cutting equipment for overlapped continuous forms, according to a first embodiment of the invention.

A transversal cutting equipment 41 for sheets separable from continuous forms 23H, 23L, in accordance with the invention is shown in FIG. 3. The equipment 41 comprises a double cutter 42, similar to the double cutter 22 of FIG. 1 and, with same numbering, the input feeding devices 26H and 26L, the loop-forming devices 27L and 27H, the introduction devices 28H and 28L, and the cutting device 29.

Specifically, the equipment 41 comprises an extraction and trimming device 44 for extracting and trimming the sheets from the cutting device 29, a singularizing device 46 for the overlapped sheets, and an accumulating and forwarding device or output buffer 47 for a document. An electronic unit 48 controls the introduction devices 28H and 28L, the cutting device 29, the extraction and trimming device 44, the singularizing device 46 and the output buffer 47.

Figure 4:
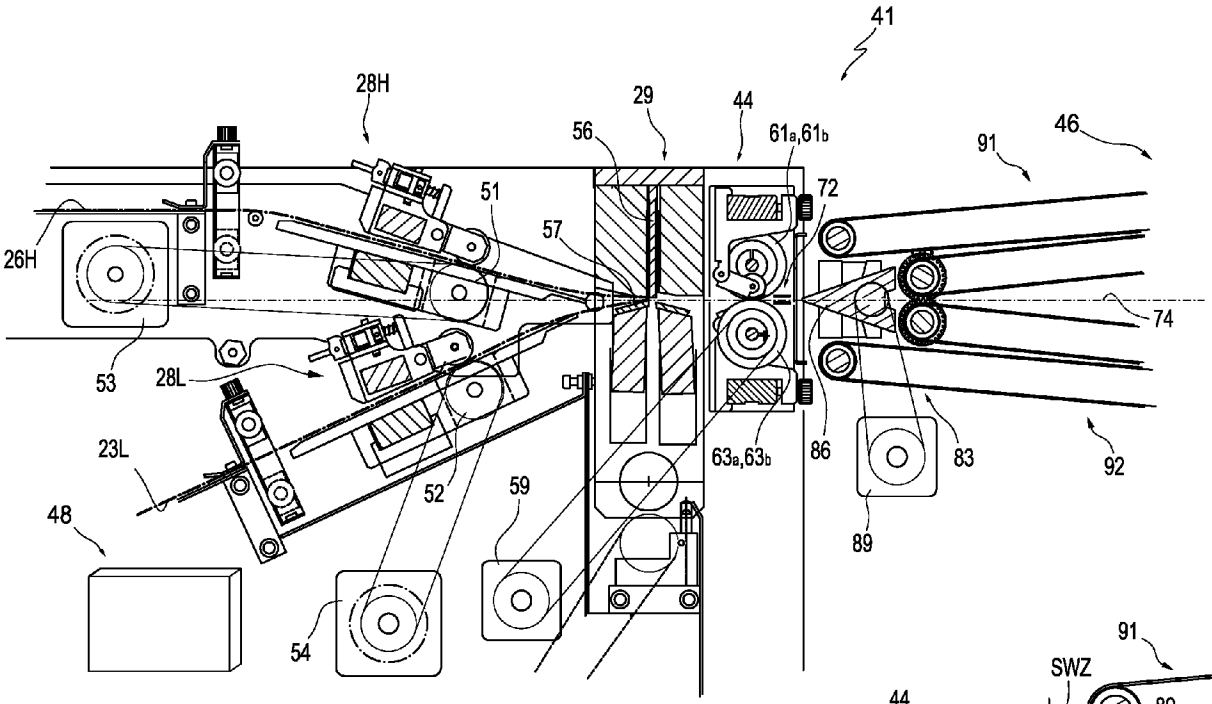
FIG. 4 shows a schematic view in a further enlarged scale, of details of the equipment of FIG. 3*a;*

The introduction devices 28H and 28L are provided for introducing the continuous forms 23H and 23L into the cutting device 29 in a high-low overlapping condition and comprise respective feeding rollers 51 and 52 (FIG. 4) and pinch rollers for the taken of the continuous forms and driving motors 53 and 54. On control of the electronic unit 48, the motors 53 and 54 drive the rollers 51 and 52 for a positive feeding of the continuous forms 23H and 23L through the cutting device 29.

The cutting device 29 comprises guides for the overlapped continuous forms 23H and 23L, a guillotine blade 56 and a counter blade 57 which define a transversal cutting surface for the forms 23H and 23L. A motor 58, controlled by the electronic unit 48, actuates the blade 56 via a, not shown, cam mechanism.

Figure 5:
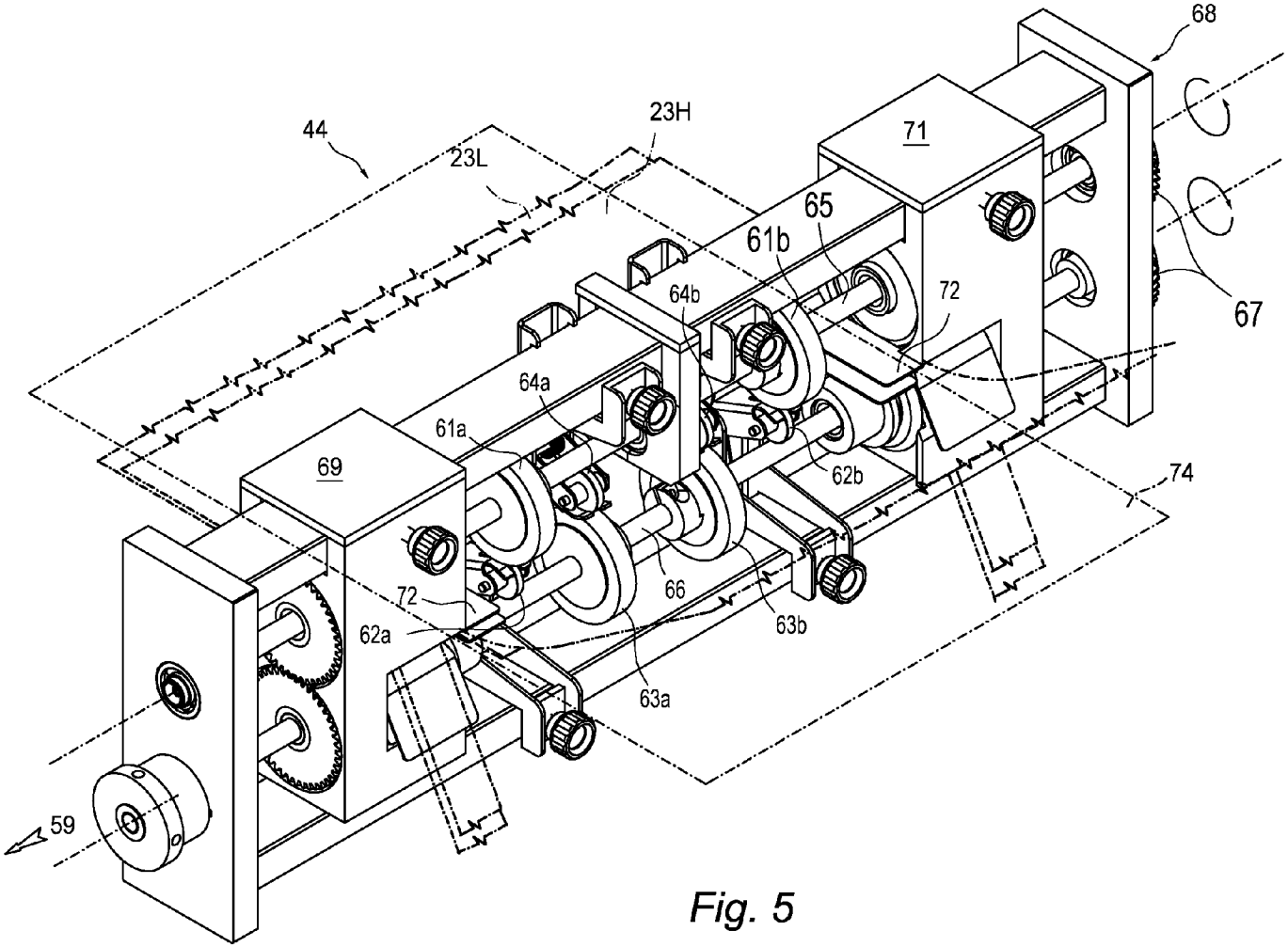
FIG. 5 represents a schematic perspective view of some components of the equipment of FIG. 3.

The extraction and trimming device 44 is actuated by a motor 59 and is provided for extracting, by friction and possibility of sliding, the overlapped continuous forms 23H and 23L emerging from the cutting device 29 independently from each other. To this end, for the extraction of the forms 23H, the device 29 comprises upper feeding rollers 61*a* and 61*b* (FIG. 5) and lower pinch rollers 62*a* and 62*b*. For the forms 23L, the device 44 comprises lower feeding rollers 63*a* and 63*b* and upper pinch rollers 64*a* and 64*b*. The feeding rollers 61*a* and 61*b*, and 63*a* and 63*b* are keyed on respective shafts 65 and 66 and in which the shaft 66 is driven by the motor 59. In turn, the shaft 65 is rotated by the shaft 66, in a condition of synchronism, through a pair of gears 67, while the pinch rollers 62*a* and 62*b* and 64*a* and 64*b* are idle mounted on respective bridge members, which are spring pushed against the feeding rollers 61*a* and 61*b* and 62*a* and 62*b*.

Suitably, the extraction and trimming device 44 comprises a frame 68, of rotatable support for the shafts 65 and 66, and two trimming groups 69 and 71. The groups 69 and 71 are, for example, rotating blades driven by the shafts 65 and 66 and provide to a side trimming of the forms 23H and 23L. Guides 72 are also provided for outputting the continuous forms and which define a geometric reference surface 74, substantially horizontal, passing through the guides of the cutting device 29.

In particular, the feeding rollers 63*a* and 63*b* and the pinch rollers 64*a* and 64*b* are provided for engaging the continuous forms on the reference surface 74, transversely to the direction of advancement of the continuous forms, in a staggered manner with respect to the feeding rollers 61*a* and 61*b* and the respective pinch rollers 62*a* and 62*b*. The peripheral velocity of the feeding rollers is greater than the maximum velocity of the introduction devices 28H and 28L to ensure an extraction of the sheets devoid of jamming, according to a known technique.

According to the invention, the singularizing device 46 (FIG. 3) comprises transport paths 81 and 82 arranged, respectively, above and below the reference surface 74 and having differentiable transfer times, and a diverter 83 upstream of the transport paths 81 and 82. Specifically, the diverter 83 is interposed between the extraction and trimming device 44 and the transport paths 81 and 82 and is configurable to address a continuous form or the two forms 23H and 23L from the cutting device 29 through the extraction and trimming device 44 to one or both transport paths 81 and 82.

The electronic unit 48 controls the input devices 28H and 28L for making a leading edge of one of the continuous forms 23H and 23L, at the output from the extraction and trimming device 44 to temporarily overtake the edge of the underlying or overlying form with projection up to a switching zone SWZ of the diverter 83. The introduction devices 28H and 28L are also actuatable for operating on the two continuous forms so as to align the trailing edges of the one and of the other form 23H and 23L, after the overtaking of one of the forms, for a joint cutting of the overlapped forms by the cutting device 29.

Figure 4A:
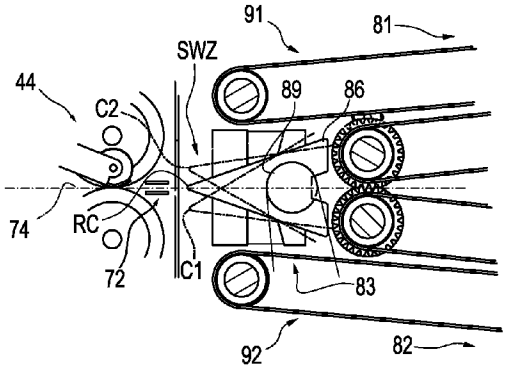
FIG. 4*a* is a schematic view representative of different operative conditions of some elements of FIG. 4.

The diverter 83 (FIG. 4*a*) can be positioned according to three different configurations: a first configuration "C1", provides the output of the cutting device 29 to be connected with one of the two transport paths 81 and 82, a second configuration "C2" provides the connection with the other transport path and a reference configuration "RC" allows the separated transport of the continuous forms 23H and 23L along the two transport paths 81 and 82.

In detail, the diverter 83 (FIG. 4) comprises a switch wedge 86 extending transversely across the width of the continuous forms 23H and 23L, with a front edge facing the guides 72 of the extraction and trimming device 44 and upper and lower guiding sides. The front edge of the switch edge 86 defines the switching zone SWZ (FIG. 4*a*) of the diverter 83 and the guiding sides are, respectively, inclined upward and downward and have function of guide for the forms 23H and 23L. The wedge 86 can rotate, with the change of configuration, by means of a transversal shaft 89, among a rest central position for the reference configuration "RC" and two inclined positions, respectively downward (FIG. 6*b*) and upward (FIG. 6*a*), associated, respectively, to the first configuration "C1" and the second configuration "C2".

The diverter 83 is actuated by a motor 89 (FIGS. 2 and 4), for example a high speed stepping motor, with positions controlled by the electronic unit 48. The transmission of the motion for the inclination of the wedge 86 is carried out in any known way, as via a belt-pulley coupling.

In the central position of the reference configuration "RC", the switch wedge 86 (FIG. 4*a*) has the front edge lying on the reference plane 74 and defines with the guiding sides access paths for the transport paths 81 and 82. In the configuration "C1", the upper guide side defines the access to the upper transport path 81 while, in the configuration "C2", the lower guide side defines the access to the lower transport path 82.

Conveniently, the cutting equipment 41 (FIGS. 2, 3 and 4) includes, upstream and downstream of the transport paths 81 and 82, an input section with upper and lower input driving belts 91 and 92 and, respectively, an output section with upper and lower output driving belts 93 and 94. The input belts 91 and 92 have accesses converging towards the extraction and trimming device 44 and ensure the movement of the sheets separated from the forms 23H, 23L and emerging from the extraction and trimming device towards the transport paths 81 and 82. In turn, the belts 93 and 94 have outputs converging towards the output buffer 47 and provide for the movement of sheets or documents from the transport paths 81 and 82 to the output buffer 47.

Figure 3A:
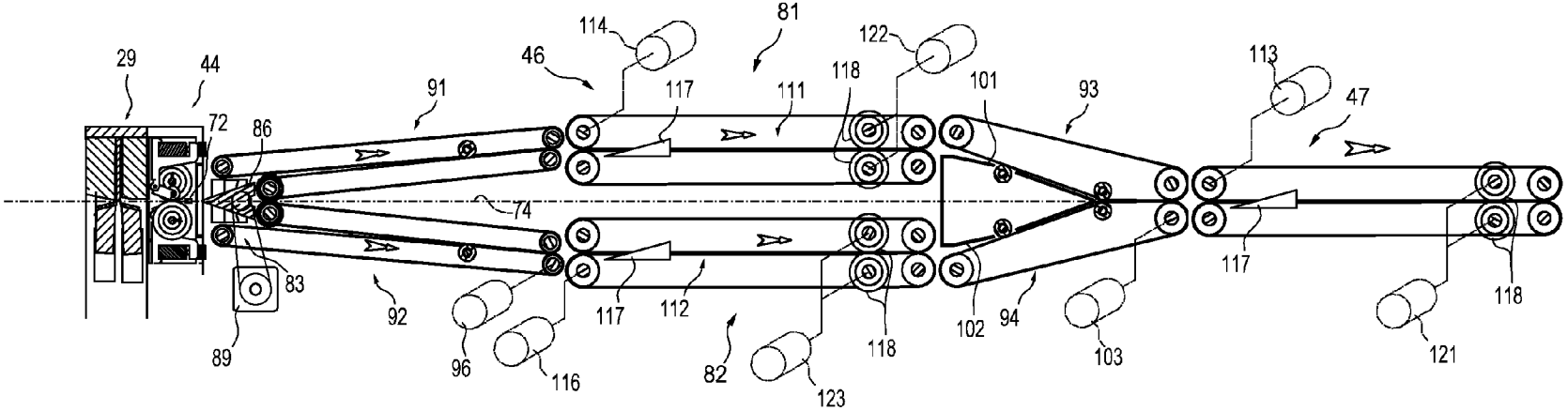
FIG. 3*a* is a schematic view, in enlarged scale, of some components of the equipment of FIG. 3.

The extensions of the input driving belts 91 and 92 and the output driving belts 93 and 94 (FIG. 3*a*) are suitably longer than the length of the longest sheets separable from the continuous forms 23H and 23L. It for ensuring an independent shift of the cut sheets by the kinematic mechanisms constituting the transport paths 81 and 82 and the input and output sections of the singularizing device 46.

With reference to the direction of advancement of the continuous forms 23H and 23L, the input driving belts 91 and 92 are inclined upward and, respectively, downward, while the output driving belts 93 and 94 are, respectively, inclined downward and upward.

The input driving belts 91 and 92 each comprise overlying belts and underlying belts facing with each other for frictionally cooperating with the forms 23H and 23L emerging from the cutting device 49 before or after the transversal separation. In particular, the overlying belts of the upper driving belts 91 and the underlying belts of the lower driving belts 92 are protruding with respect to the other belts of the pairs. This for making easier the engagement, without jamming, of the forms 23L and 23H with the driving belts toward the transport paths 81 and 82, in the inclined positions of the switch wedge 86. A motor 96 provides for the movement of the driving belts 91 and 92 in a synchronism condition through, not shown, transmission member with transport velocity for the forms and the cut sheets a little higher than the one of the extraction and trimming device 44.

The output driving belts 93 and 94 are faced to guide surfaces 101 and 102 and rolls for frictionally cooperating with the forms 23H and 23L emerging from the transport paths 81 and 82. In detail, the guide surfaces 101 and 102 form a diedre with a corner adjacent to the input of the accumulating and forwarding device 47. A motor 103 provides to move the belts 93 and 94, in a synchronism condition, by means of, not shown, transmission members with a transport velocity for the sheets a little higher than the velocity of the sheets at the output from the transport paths.

In use, a reference transport path of the transport paths 81 and 82, in the configuration "C1" or in the configuration "C2" of the diverter 83 is provided for receiving the first odd sheet, or the first couple of pair sheets of a reference document, up to the last single sheet or the last couple of sheets originally flanked on the continuous base form 24.

For a document that ends with a single sheet, when the leading edge of said sheet has passed the switching zone SWZ, the diverter 83 is switched to the second configuration C2 or, respectively, to the first configuration C1, with limited deflection of the first sheet, for the access of the other sheet to another transport path. After overcoming the switching zone by the leading edge of the other sheet, the diverter is switched to the reference configuration to minimize the switching times and reducing friction on the switch wedge. The advancing of the two sheets continues until alignment of the trailing edges with the cutting surface of the cutting device 29. It is followed by the simultaneous cutting of the two sheets and their extraction by the extraction and trimming device 44.

Figure 2:
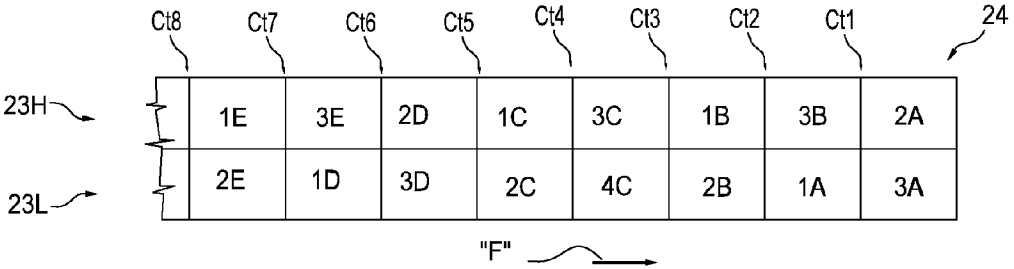
FIG. 2 shows a schematic view of a continuous form as basis for the formation of documents.

The procedure is similar also for the document that ends with a pair of flanked sheets, as for the continuous base form 24 of FIG. 2. Then, the sheets are overlapped in the cutting device 29. In this case, however, the diverter 83 is switched to the reference configuration "RC" immediately after passage of the switching zone SWZ by the overlapped sheets.

Both for the document that ends with the single sheet, and for a document that ends with two originally flanked sheets, the diverter 83 can be switched to another configuration such as to allow the other transport path to receive respectively the first sheet single, or the first pair of adjacent sheets of a subsequent document, while the one transport path forwards the reference formed document to the output buffer 47 for further processings.

In accordance with a first embodiment of the invention of FIG. 3, the transport paths 81 and 82 include a respective accumulating and forwarding device or upper and lower intermediate buffers 111 and 112 to collect a sheet or a plurality of sheets of a document in formation and forward the document to the output buffer 47.

The accumulating and forwarding devices or buffers 47, 111 and 112 are similar to the accumulating and forwarding device 34 of FIG. 1 and, for what concerns the stacking of the sheets, each accumulating and forwarding device comprises upper and lower driving belts controlled by a respective motor 113, 114 and 116 (FIG. 3*a*), and a stepping ramp 117. For the forwarding of documents, each buffer 47, 111 and 112 comprises a pair of rollers 118 driven by a respective motor 121, 122 and 123, and in which the rollers 118 have possibility of longitudinal adjustment in function of the length of the sheets to be stacked. The rollers 118 are provided for stopping the sheets in the stacking, in the condition in which the motors 121, 122 and 123 are stationary, and to forward formed documents to following processing with the actuation of the same motors.

Suitable detectors, for instance of photoelectric type, not shown in the drawings, detect the correct passage of the sheets between the various sections of the singularizing device 46, signaling any condition of jam. Also for the output buffer 47, the electronic unit 48 controls the motor 113 so as to impose a velocity of the driving belts higher than one of the sheets at the output from the driving belts 93 and 94. The transport velocities have high values increasing from the input section, to the intermediate buffers 111 and 112, the output section and the output buffer 47, but within conservative safety limits.

By means of the above described structure, the cutting equipment 41 can operate, without interruptions, by effecting cuts on the overlapped continuous forms, substantially at the maximum actuating velocity of the cutting device 29, ensuring smooth and reliable operations.

Similarly to the accumulating and forwarding device 34 of the equipment 21 of FIG. 1, the accumulating and forwarding devices or buffers 47, 111 and 112 are suitably configurable for stacking the sheets from top to bottom or from bottom to top and forwarding the formed document for further processing. The arrangement of the pages on the continuous base form is such that, after the separation and transfer to the accumulating and forwarding device, the sequence of the stacked sheets results a natural sequence, with the first page higher in the stack that constitutes the document. For a stacking of the sheets from top to bottom, the arrangement of the pages in the continuous base form 24 follows a regressive order with respect to the feeding direction "F". On the contrary, for a stacking of the sheets from bottom to top, the arrangement of the pages follows a progressive order.

Figure 8A:
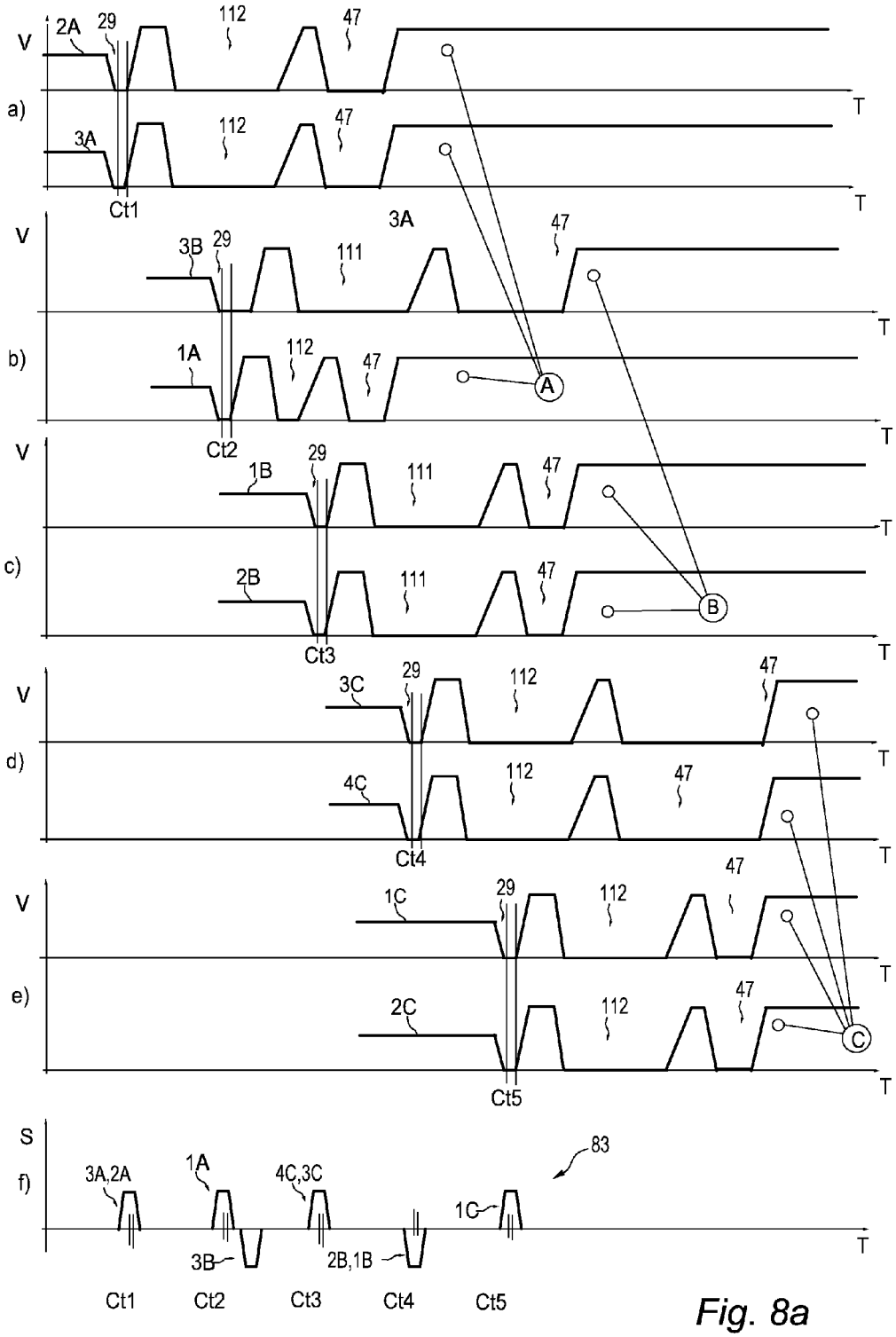
FIGS. 8*a* and 8*b*, "a"-"e" and "g"-"i" are velocity/time diagrams regarding some sheets of FIG. 2 processed by the equipment according to the invention, while "f" and "l" are space/time diagrams of a component of FIG. 3.
Figure 8B:
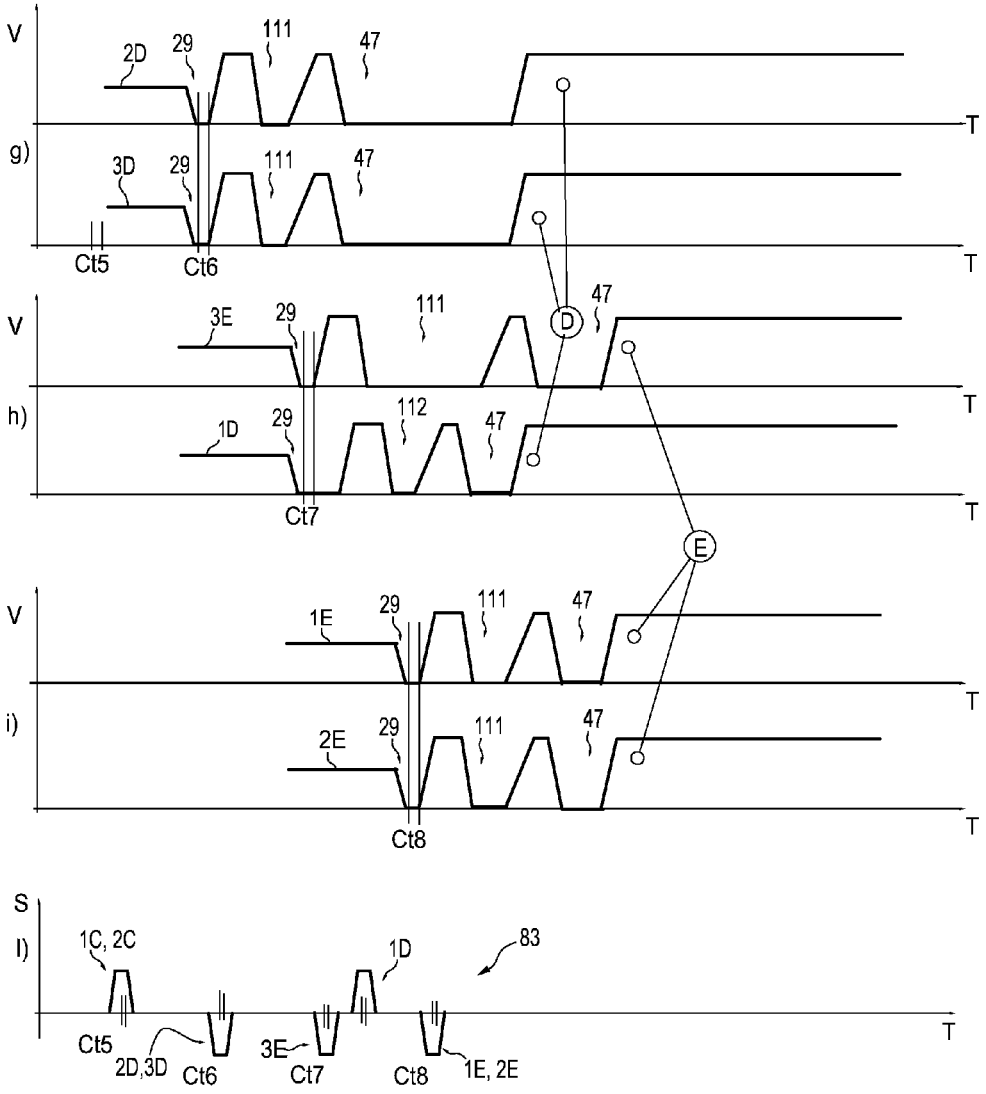

The operation of the equipment 41 is described by way of example, with reference to the continuous forms 23H and 23L derived from the continuous base form 24 of FIG. 2 and introduced into the cutting device 29 (FIG. 3) according to a high-low overlapping condition. The pages are printed side by side with a regressive order for the forming of documents as: "A" (sheets 3A-1A), "B" (sheets 3B-1B), "C" (sheets 1C-4C), "D" (sheets 3D-1D) and "E" (sheets 3E-1E) and performing sequential cuttings Ct1-Ct8 (FIGS. 8*a* and 8*b*).

Figure 6A:
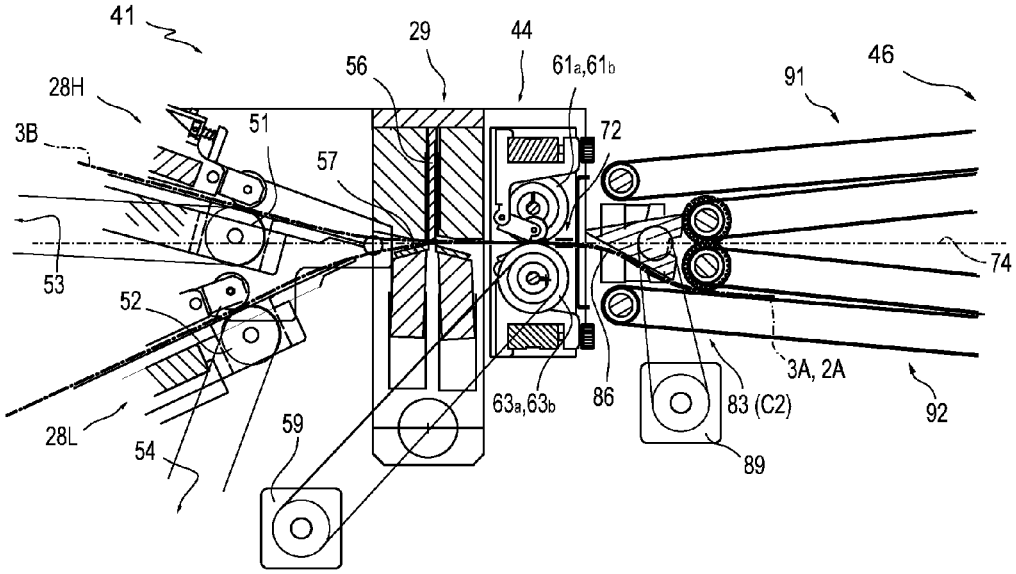
FIGS. 6*a*-6*f* show different operative conditions of details shown in FIG. 4.
Figure 6B:
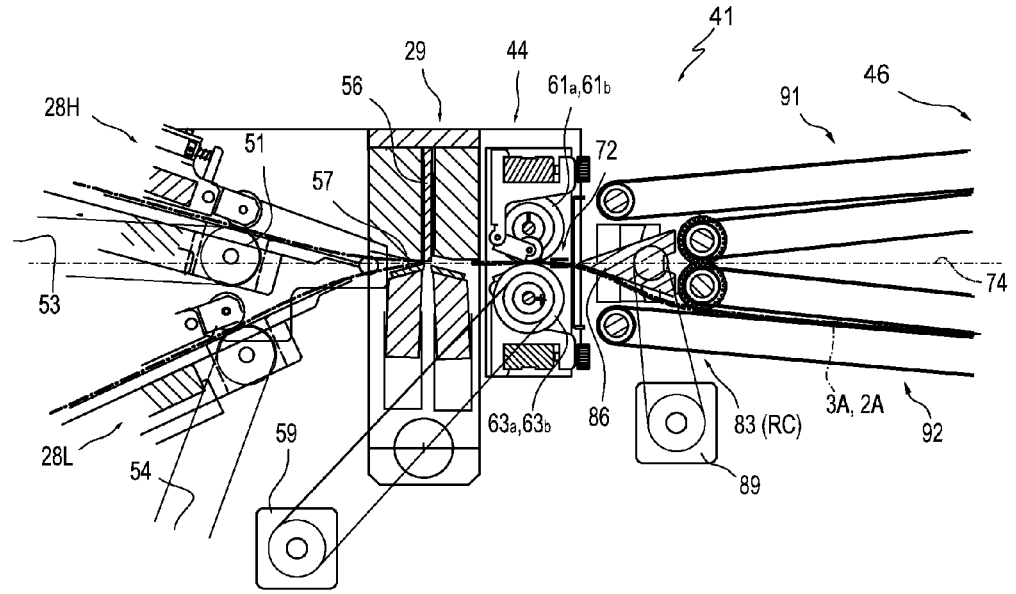

With reference to FIGS. 2, 3, and 6*a*, for the preparation of the document "A" (see also FIG. 8*a*, "A" and "B"), the electronic unit 48 activates the diverter 83 for the second configuration "C2" and the introduction devices 28H and 28L for the joint advancing of the continuous forms 23H and 23L, with extraction by the extraction and trimming device 44. The switch wedge 86 (see also FIG. 8*a*, "f") takes the upper inclined position, while the leading edges of the continuous forms 23H and 23L are diverted by the lower side of the wedge 86 and shifted by the lower driving belts 92. The electronic unit 48 now activates the diverter 83 for the reference central configuration "RC" and proceeds with the advancement of the forms 23H and 23L up to the length of the sheets 3A and 2A. Now, the electronic unit 48 arrests the introduction devices 28H and 28L and activates the cutting device 29 to execute the cut "Ct1" (FIG. 8*a* "a") with transversal separation of the sheets. The sheets 3A and 2A, while maintain their overlap condition, leave the belts 92 and are deposited into the buffer 112, arrested by the rollers 118.

Figure 6C:
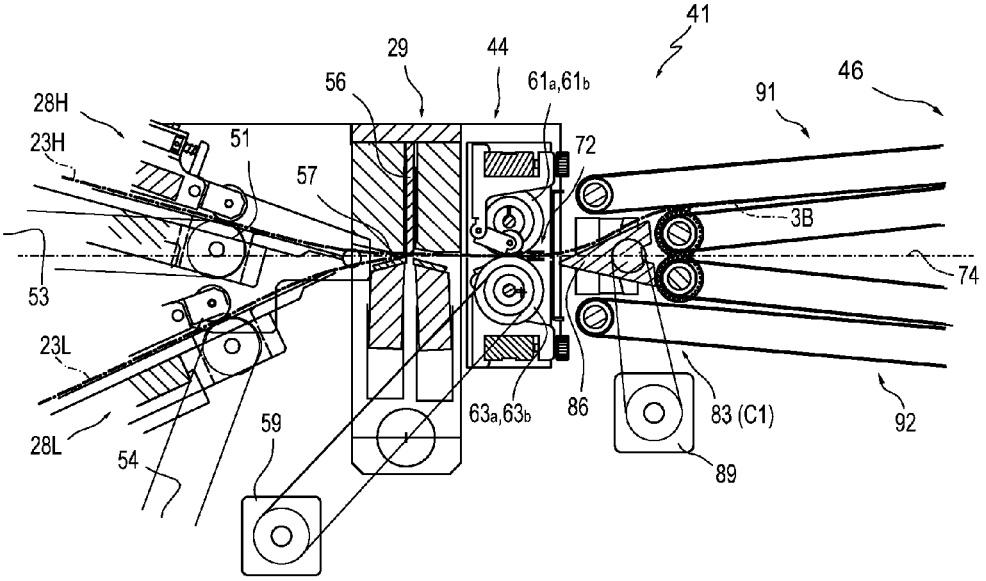
Figure 7:
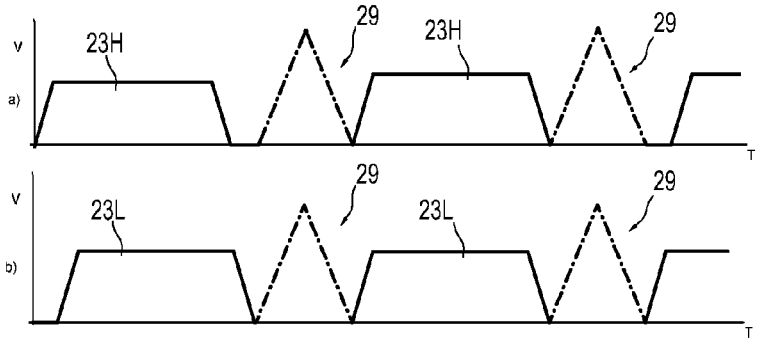
FIG. 7 is a schematic velocity/time diagram of continuous forms, in the use with the equipment of the invention.

In sequence, the electronic unit 48 activates the diverter 83 to the first configuration "C1" and the introducing device for an overtaking of the form 28H (FIGS. 6*c* and 7), sheet 3B (see also FIG. 8*a*, "B" and "f"), with extraction by the upper feeding rollers 61*a* and 61*b* of the extraction and trimming device 44. The switch wedge 86 takes the downward inclined position, while the leading edge of the form 23H is diverted by the upper guiding side of the wedge 86 and is shifted by the upper driving belts 91.

Figure 6D:
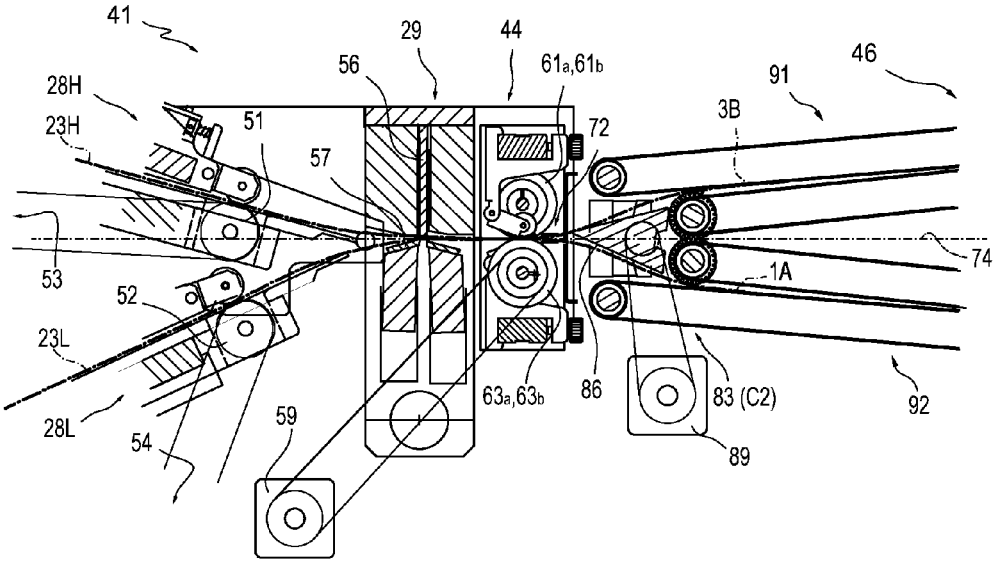
Figure 6E:
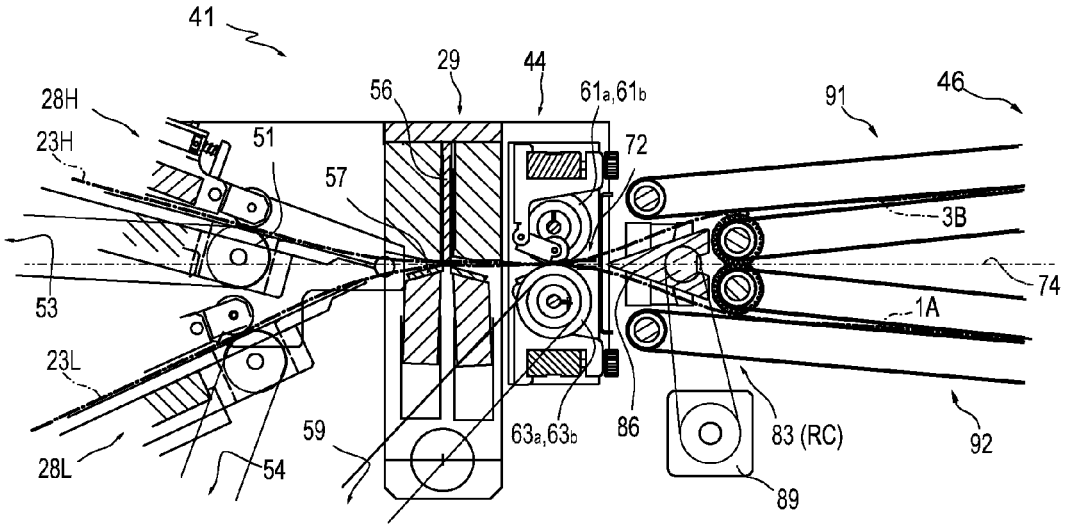
Figure 6F:
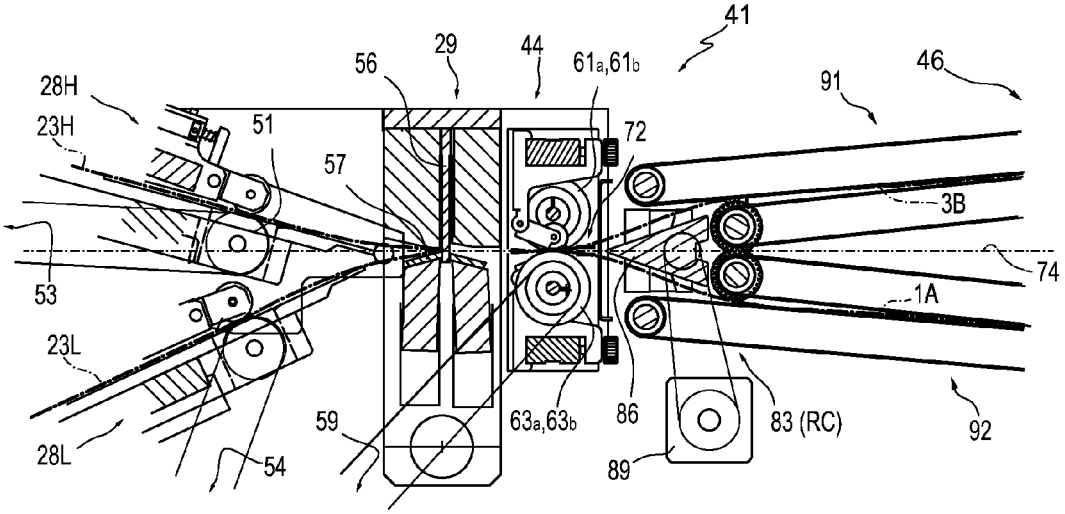

When the continuous form 23H overcomes the switching zone SWZ of the diverter 83, the electronic control unit 48 activates the diverter 83 to the second configuration "C2" (FIG. 6*d*) and activates the introduction device 28L for advancing also the form 23L, sheet 1A. The switch wedge 86 takes the upward inclined position (see also FIG. 8*a*, "f"), while the leading edge of the form 23L is diverted by the lower guide side of the wedge 86 and is engaged for the shifting by the driving belts 92. The edge of the switch wedge 86 also causes a small deformation of the form 23H, without substantial troubles to its movement. The unit 48 activates the diverter 83 for the central reference configuration "RC" (FIG. 6*e*) and proceeds with the advancement of the continuous forms 23H and 23L, jointly extracted by the extraction and trimming device 44, and engagement with the input belts 91 and 92.

The advancing of the continuous form 23H proceeds up to a stop when the form reaches the length of the sheet 3B, while the advancing of the form 23L is arrested when the form reaches the length of the sheet 1A. The electronic unit 48 then activates the cutting device 29 for the cut "Ct2" (FIG. 8*a* "b"). The sheets 3B and 1A leave the belts 91 and 92 and are deposited into the buffer 111 and, respectively, into the buffer 112, above the sheets 3A and 2A and arrested by the rollers 118. Upon completing of the document "A" in the buffer 112, the unit 48 activates the motor 123 for forwarding the document to the output belts 94 and, in sequence, activates the motor 118 of the output buffer 47 for following processing.

By proceeding with the formation of the document "B", the electronic unit 48 activates the diverter 83 for the configuration "C1", the introduction devices 28H and 28L for the joint advancing of the continuous forms 23H and 23L and a following activation of the diverter 83 for the configuration "RC". The continuous forms 23H and 23L are advanced by the input belts 91 up to the length of the sheets 2B and 1B (see also FIG. 8*a*, "c" and "f"); then, the unit 48 arrests the introduction devices 28H and 28L and activates the cutting device 29 for the cut "Ct3" (FIG. 8*a* "c"). The sheets 2B and 1B, in overlapped condition, leave the belts 91 and are deposited into the upper buffer 111 on the sheet 3B, arrested by the rollers 118, completing the document "B". The unit 48 then activates the motor 122 for forwarding the document "B" to the belt 94 and the motor 121 of the output buffer 47 for following processing.

In subsequent cycles for the document "C" (FIG. 8*a*, "d", "e" and "f"), firstly the sheets 4C and thereafter the sheets 2C 1C, cuts "Ct4" and "Ct5" are accumulated into the lower buffer 112 and transferred to the output buffer 47, in a manner similar to that described with reference to the document "A".

For the document "D" (FIG. 8*b* "g" and "h"), with the diverter 83 in configuration "C1", the sheets 2D and 3D are engaged for the transport by the upper input belts 91. After a cut "Ct6" (FIG. 8*b* "g") the sheets pass through the upper buffer 111 and are accumulated, in a waiting condition, into the output buffer 47.

On a following advancing step, cut "C7" (FIG. 8*b* "h"), the sheet 3E of the document "E" (FIG. 8*b*, "h" and "l") stops into the upper buffer 111, already devoid of the sheets 2D and 3D. In turn, the sheet 1D passes through the lower buffer 112, overlaps the sheets 2D and 3D into the output buffer 47 completing the document, and successive forwarding of the document "D".

The continuous forms 23H and 23L advance together for the sheets 1E and 2E of the document "E", cut "Ct8" (FIG. 8*b*, "i" and "l"): then, the sheets are accumulated into the upper buffer 111 and transferred to the output buffer 47, in a manner similar to that described with reference to the document "B".

The operation of the equipment 41 for the formation of documents other than those described will be very similar to that previously described and illustrated, with the obvious modifications of the case.

Naturally, the principle of the invention remaining the same, the embodiments and the details of construction can broadly be varied with respect to what has been described and illustrated, by way of non-limitative example, without by this departing from the ambit of the present invention.

Figure 9:
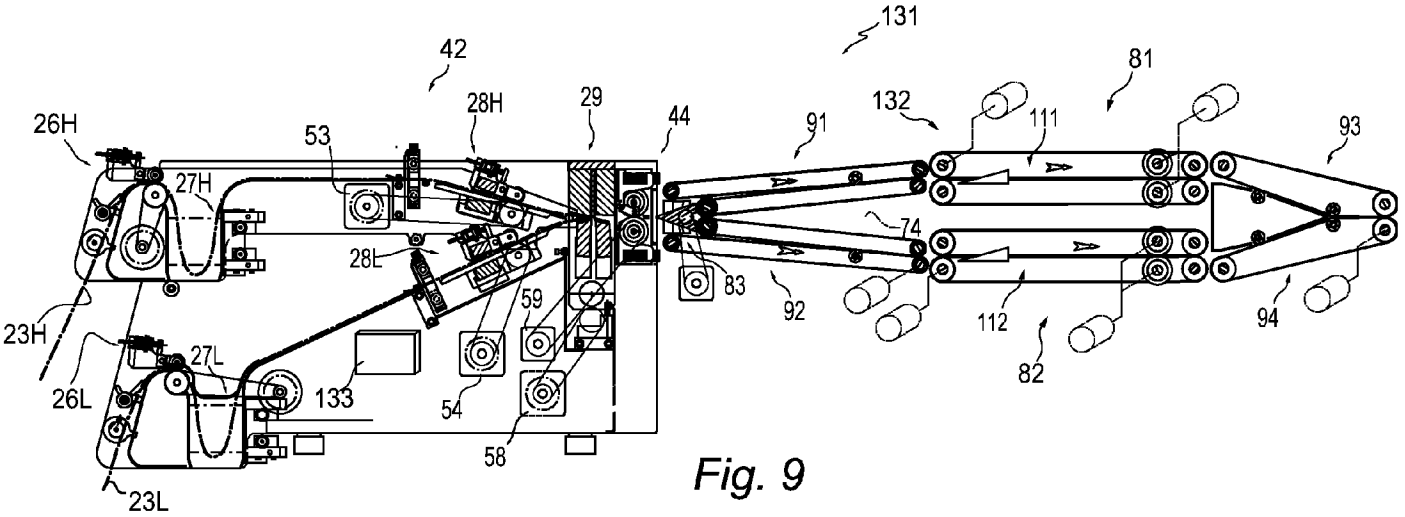
FIG. 9 shows a variant of the equipment of the invention.

By way of example, a cutting equipment 131 according to the invention similar to the cutting equipment 41 is shown in FIG. 9. The cutting equipment 131 comprises a singularizing device 132 with the diverter 82, but devoid of the output buffer and with an electronic unit 133 which controls the conditions of overlap-flanking of the sheets. This is carried out by means of algorithms which take account of the compositions of the previous document and/or the document following the current one. In the control for the actuation of the cutting device 29, the electronic unit 133 can also respond to the effective conditions of emptying of the buffers for what concerns the accumulation of the sheets into the upper buffer 111 or the lower buffer 112.

Figure 10:
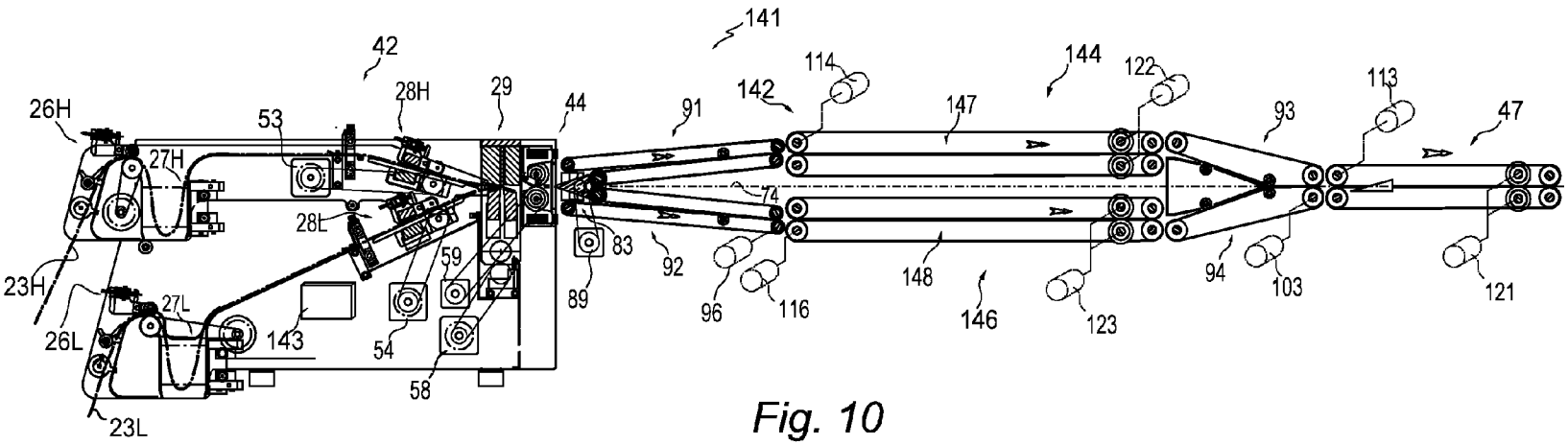
FIG. 10 is another variant of the equipment of the invention.

A cutting equipment 141 in accordance with the invention is shown in FIG. 10. The cutting equipment 141 is also similar to the equipment 41 for what concerns the presence and functions of the diverter 82, but includes a different singularizing device 142, an electronic unit 143 and transport paths, herein indicated by 144 and 146. The transport paths include upper driving belts 147 and lower driving belts 148 and are devoid of the respective intermediate buffers. The transfer times of the respective driving belts 147 and 148 are differentiated as in the cited patent IT 1,397,442 of Tecnau S.r.l.

The transport paths 144 and 146 of the equipment 141 are provided for transferring the continuous forms 23H and 23L separately or together in the overlap condition along the path 144 or along the path 146 toward the accumulating and forwarding device or output buffer 47. Conveniently, the length of the belts 147 and 148 is greater than that of the belts 111 and 112 of the equipment 41 of FIG. 3 to achieve differences in the transfer times compatible with the cycles of actuation of the cutting device 29 and transport velocity of the sheets within acceptable safety limit for transfers without jams or breakages.

We claim:

1. A method for transversal cutting sheets separable from continuous overlapped forms, employing a cutting equipment comprising a cutting device for a joint transversal separation of the sheets; introduction devices for entering the forms into the cutting device and a singularizing device for the overlapped sheets including two transport paths, the one above the other, with differentiable transfer times, said cutting equipment further comprising, as singularizing device, a diverter member upstream of the transport paths and wherein said method provides the following steps:

a) actuating the introduction devices, for temporarily projecting a leading edge of one of the overlapped forms with respect to the other form up to a switching zone of the diverter member, or for advancing together the overlapped forms;

b) configuring the diverter member for addressing a form or both forms to one or to both transport paths; and c) actuating the introduction devices, in the case of projecting of one of the forms, for lining up the trailing edges of the one and the other form for a joint cutting of the overlapped forms by means of the cutting device.

2. Method for transversal cutting sheets according to claim 1, wherein the forms are longitudinally separated from a base continuous form for forming documents with a single sheet or with more stacked sheets, and said sheets are printed as side by side columns of the base form according to a predetermined regressive or progressive order, wherein said equipment further comprises an output accumulating and forwarding device or buffer for sheets outgoing from the transport paths, said method further providing the followings steps:

d) configuring the diverter member so that a reference transport path of the transport paths is provided for receiving a first pair of sheets or a first odd sheet, of a reference document;

e) proceeding with the formation of the reference document until a last single sheet or a last pair of sheets;

f) switching the diverter member for another configuration such as to allow the other transport path to receive, respectively, a first single sheet, or, in an overlapped way, the first pair of side by side sheets of a following document, after a last single sheet or a last pair of sheets of the reference document has passed the switching zone of the diverter member;

g) actuating the one transport path for forwarding a formed reference document to the output accumulating and forwarding device or buffer, for subsequent operations; and h) forming the following document up to the stacking of the last single sheet or the last pair of side by side sheets of said following document.

3. Improvements to a transversal cutting equipment for sheets separable from overlapped continuous forms, comprising a cutting device for a joint transversal separation of the sheets, introduction devices for entering the continuous forms into the cutting device and a singularizing device for overlapped sheets including two transport paths, the one above the other, with differentiable transfer times, wherein said singularizing device comprises a diverter member upstream of the transport paths and wherein said diverter member defines a switching zone and is configurable among a first configuration, a second configuration and a reference configuration;

said introduction devices are actuatable for temporarily projecting a leading edge of one of the overlapped forms with respect to the other form up to the switching zone of the diverter member, or for advancing together said overlapped forms; and said diverter member defines a first access path from the cutting device to one of the two transport paths in the first configuration and a second access path from the cutting device to the other transport path in the second configuration for addressing, respectively, a continuous form or both forms to the one or the other transport path; wherein said diverter member further allows accesses to the first access path and the second access path from the cutting device to the two transport paths in said reference configuration for addressing both forms to both transport paths; and wherein said introduction devices are also actuatable, in the case of projecting of one of the continuous forms, for lining up trailing edges of the sheets of the one and the other form for a joint cutting of the overlapped forms by means of the cutting device.

4. Cutting equipment according to claim 3 further comprising an extraction device for extracting the forms from the cutting device, wherein said extraction device defines output guides and is arranged for operating on both the forms in order to extract, through said guides, one form, with sliding with respect to the other form or extract, without reciprocal sliding, the overlapped forms;

said diverter member comprises a switch wedge having a front edge facing the output guides of the extraction device and two guiding sides inclined upward and downward;

said switch wedge is rotatable among a central rest position for the reference configuration and two inclined positions, respectively downward and upward associated, respectively, to the first configuration and the second configuration; and wherein said front edge represents a beginning of the switching zone, said central rest position corresponds to the reference configuration for the addressing of both forms to both transport paths and said two inclined positions, correspond to the first configuration and the second configuration for the addressing of a form or both forms to the one or the other transport path.

5. Cutting equipment according to claim 3, with forms emerging substantially horizontally from the cutting device, said equipment further comprising input upper and lower drive belts between the cutting device and the transport paths, and wherein the diverter member comprises a switch wedge, which is provided for rotating, with a change of configuration, between a central rest position, in the reference configuration of the diverter member, and two inclined positions by opposite side with respect to the rest position in the first configuration and in the second configuration, and wherein the switch wedge, in one of the two inclined positions defines an access to path the upper drive belts, in the other inclined position defines an access path to the lower drive belts and, in the central rest position, allows the dragging of the forms by both the input upper and lower drive belts.

6. Cutting equipment according to claim 5, wherein the switch wedge is actuated by a controlled motor.

7. Cutting equipment according to claim 5, wherein the input upper and lower drive belts have inputs facing the cutting device and each including overlying belts and underlying belts facing each other for frictionally cooperating with sheets cut from the continuous forms, and wherein the overlying belts of the input upper drive belts and the underlying belts of the input lower drive belts are projecting with respect to the other belts to facilitate the engagement of the sheets with the drive belts in the inclined positions of the switch wedge.

8. Cutting equipment according to claim 3 wherein the transport paths each include a respective intermediate accumulating and forwarding device or buffer for receiving a sheet, or receiving and stacking more sheets of a forming document and forwarding the sheet or stacked sheets of a formed document for subsequent operations.

9. Cutting equipment according to claim 8 further comprising an output accumulating and forwarding device or buffer for the sheet or the stacked sheets accumulated by each of the intermediate accumulating and forwarding devices.

10. Cutting equipment according to claim 9, wherein said output accumulating and forwarding device is provided for directly forwarding, for subsequent operations, complete documents received from the intermediate accumulating and forwarding devices, and for retaining incomplete documents waiting for a last sheet from the intermediate accumulating and forwarding devices and wherein said last sheet has direct transit through one of the intermediate accumulating and forwarding devices, and for forwarding for the subsequent operations a document completed with said last sheet.

11. Cutting equipment according to claim 8 further comprising an electronic unit and wherein said electronic unit controls the conditions of overlap-flanking of the sheets for taking account of the compositions of the previous document and/or the document following a current document and effective conditions of emptying of the respective intermediate accumulating and forwarding device for the actuation of said cutting device.

12. Cutting equipment according to claim 3, for continuous forms separated by longitudinal cutting from a base continuous form and for forming documents with printed sheets according to a regressive or progressive order, wherein said equipment uses an output accumulating and forwarding device and intermediate accumulating and forwarding devices or a single output accumulating and forwarding device of the type with stacking of the sheets from the top or from the bottom according to the regressive or progressive printing order on the base form.

13. Improvements to a transversal cutting equipment for sheets separable from overlapped continuous forms, comprising a cutting device for a joint transversal separation of the sheets, introduction devices for entering the continuous forms into the cutting device and a singularizing device for overlapped sheets including two transport paths, the one above the other, with differentiable transfer times, wherein said singularizing device comprises a diverter member upstream of the transport paths, wherein said introduction devices are actuatable for temporarily projecting a leading edge of one of the overlapped forms with respect to the other form up to a switching zone of the diverter member, or for advancing together said overlapped forms;

said diverter member is configurable for addressing a continuous form or both forms to one or to both transport paths;

said introduction devices are also actuatable, in the case of projecting of one of the continuous forms, for lining up trailing edges of the sheets of the one and the other form for a joint cutting of the overlapped forms by means of the cutting device; and said equipment is provided, for documents with printed sheets according to a predetermined regressive or progressive order, wherein the transport paths define a slow path for a slow transport or a transport with arrest of sheets belonging to a document following a document in formation and a fast path for sheets of the document in formation, and wherein the transport paths are provided for transporting in overlapped way forms belonging, in tiled pair, to said document in formation.

14. Cutting equipment according to claim 3, further comprising an extraction device for extracting the forms from the cutting device, and wherein the extraction device is arranged for operating on both the forms in order to extract one form, with sliding with respect to the other form or extract, without reciprocal sliding, the overlapped forms.

15. Cutting equipment according to claim 14, wherein the extraction device comprises upper feeding rollers and lower pinch rollers for the engagement with the one form and lower feeding rollers and upper pinch rollers staggered with respect to the upper feeding rollers and lower pinch rollers for the engagement with the other form.

* * * * *